US008893324B2

(12) United States Patent
Griffin et al.

(10) Patent No.: US 8,893,324 B2
(45) Date of Patent: Nov. 25, 2014

(54) LOW PRESSURE FLUIDIZED HORIZONTAL AND VERTICAL MOVEMENT DEVICE

(75) Inventors: Exum Griffin, Easton, MD (US); Raynor A. Johnson, Newark, DE (US)

(73) Assignee: Gray Tek LLC, Dover, DE (US)

( * ) Notice: Subject to any disclaimer, the term of this patent is extended or adjusted under 35 U.S.C. 154(b) by 404 days.

(21) Appl. No.: 13/383,047

(22) PCT Filed: Aug. 6, 2010

(86) PCT No.: PCT/US2010/044653

§ 371 (c)(1), (2), (4) Date: Feb. 16, 2012

(87) PCT Pub. No.: WO2011/017589

PCT Pub. Date: Feb. 10, 2011

(65) Prior Publication Data

US 2012/0131746 A1 May 31, 2012

Related U.S. Application Data

(60) Provisional application No. 61/231,704, filed on Aug. 6, 2009.

(51) Int. Cl.
*A61G 7/10* (2006.01)

(52) U.S. Cl.
CPC ..... *A61G 7/1021* (2013.01); *A61G 7/1026* (2013.01); *A61G 2203/90* (2013.01)
USPC ..... 5/81.1 HS; 5/81.1 R; 5/655.3; 5/706; 5/710; 5/711; 5/713; 180/125; 414/676

(58) Field of Classification Search
CPC A61G 7/1021; A61G 7/1026; A61G 2203/90
USPC ..... 5/81.1 R, 81.1 HS, 691, 706, 707, 5/710–715, 731, 655.3; 414/676; 180/125
See application file for complete search history.

(56) References Cited

U.S. PATENT DOCUMENTS

| | | | | | |
|---|---|---|---|---|---|
| 3,826,329 | A | * | 7/1974 | Crimmins et al. | 180/125 |
| 4,099,276 | A | | 7/1978 | Hunt et al. | |
| 4,272,856 | A | * | 6/1981 | Wegener et al. | 5/81.1 T |
| 4,347,633 | A | * | 9/1982 | Gammons et al. | 5/713 |
| 4,417,639 | A | * | 11/1983 | Wegener | 180/125 |
| 4,504,989 | A | * | 3/1985 | Maltz | 5/655.3 |
| 4,517,690 | A | * | 5/1985 | Wegener | 5/81.1 R |
| 4,528,704 | A | * | 7/1985 | Wegener et al. | 5/81.1 R |
| 4,686,719 | A | * | 8/1987 | Johnson et al. | 5/81.1 R |
| 4,947,493 | A | * | 8/1990 | Salonica | 4/476 |
| 5,067,189 | A | * | 11/1991 | Weedling et al. | 5/81.1 R |
| 5,483,709 | A | * | 1/1996 | Foster et al. | 5/81.1 R |
| RE35,299 | E | * | 7/1996 | Weedling et al. | 5/81.1 T |
| 5,561,873 | A | * | 10/1996 | Weedling | 5/713 |
| 6,073,291 | A | * | 6/2000 | Davis | 5/711 |
| 6,199,827 | B1 | * | 3/2001 | Rimington et al. | 254/93 HP |

(Continued)

*Primary Examiner* — Nicholas Polito
*Assistant Examiner* — David R Hare
(74) *Attorney, Agent, or Firm* — Invention To Patent Services; Alex R Hobson

(57) ABSTRACT

Transfer pads for horizontal and/or vertical translocation are provided. The transfer pads include the fewest possible number of components required to provide a plenum chamber, the operative features of which are controlled at least by the provision of one or more interior sheets having specific characteristics with respect to position, perforation and attachment.

7 Claims, 10 Drawing Sheets

(56) References Cited

U.S. PATENT DOCUMENTS

| | | | | |
|---|---|---|---|---|
| 6,898,809 | B2 * | 5/2005 | Davis | 5/81.1 R |
| 7,028,350 | B1 | 4/2006 | Davis | |
| 7,107,641 | B2 * | 9/2006 | Davis | 5/710 |
| 7,373,680 | B2 * | 5/2008 | Davis | 5/711 |
| 7,376,995 | B2 * | 5/2008 | Davis | 5/710 |
| 7,480,952 | B2 * | 1/2009 | Nickerson et al. | 5/655.3 |
| 7,565,709 | B2 * | 7/2009 | Davis | 5/710 |
| 7,627,910 | B2 * | 12/2009 | Davis | 5/81.1 R |
| 7,712,170 | B2 * | 5/2010 | Davis | 5/711 |
| 7,725,963 | B2 * | 6/2010 | Johnson | 5/81.1 R |
| 7,735,164 | B1 * | 6/2010 | Patrick | 5/81.1 HS |
| 8,234,727 | B2 * | 8/2012 | Schreiber et al. | 5/81.1 HS |
| 8,387,177 | B2 * | 3/2013 | Davis | 5/81.1 R |
| 2003/0159212 | A1 * | 8/2003 | Patrick et al. | 5/81.1 R |
| 2005/0076437 | A1 | 4/2005 | Johnson | |
| 2006/0156468 | A1 | 7/2006 | Patrick | |
| 2008/0011989 | A1 * | 1/2008 | Davis | 254/93 HP |
| 2009/0165211 | A1 * | 7/2009 | Song et al. | 5/706 |

* cited by examiner

FIG. 2E2
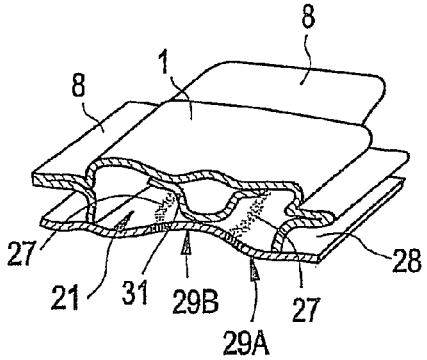
FIG. 2F
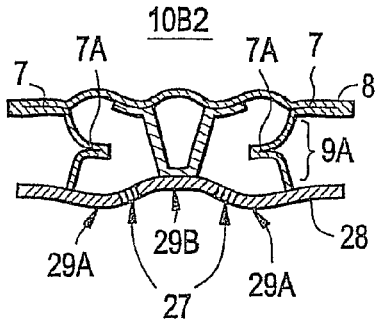
FIG. 2G
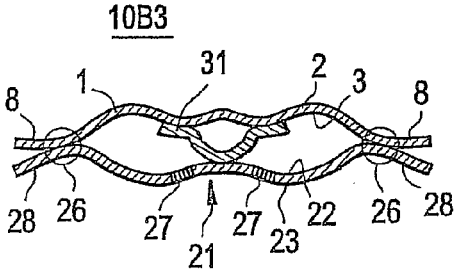
FIG. 2H
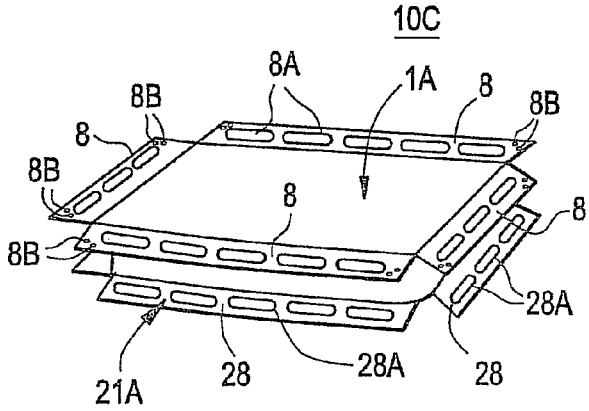
FIG. 2I
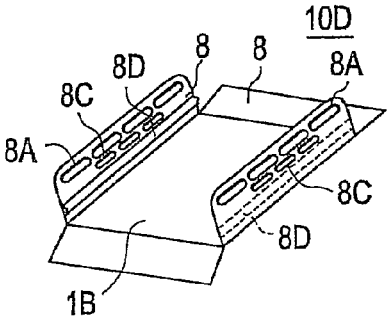
FIG. 2J
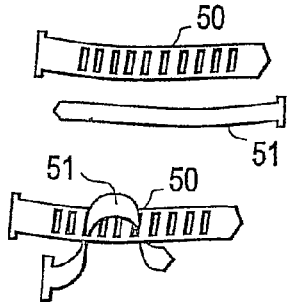

LOW PRESSURE FLUIDIZED HORIZONTAL AND VERTICAL MOVEMENT DEVICE

CROSS-REFERENCE TO RELATED APPLICATION

This application claims priority from U.S. Application Ser. No. 61/231,704, filed Aug. 6, 2009, the entirety of which is incorporated herein by reference.

FIELD OF THE INVENTION

The present invention relates, in general, to the field of pressurized fluid-filled lifting and transfer devices, and specifically to low pressure fluidized devices that perform horizontal and/or vertical transfer operations, improve effective lifetime and overall operational efficiency of the device, reduce costs and reduce the potential for injuries and damage.

BACKGROUND OF THE INVENTION

In the medical industry, there is often a need to safely and efficiently lift and transfer a patient between surfaces that may be co-planar, higher or lower with respect to one another. In the past, such transfer operations have involved the use of either complicated and expensive mechanical lift systems, or other devices that instead require physical exertion on the part of the medical personnel who must bend and lift to effect the transfer. However, injuries to both the patient and the medical personnel can be associated with moving substantially immobilized patients for treatment. Typically, the injurious nature of such transfer operations is inflicted upon the medical personnel due to the repetitive bending and lifting strains performed on a daily basis. This can lead not only to pain and discomfort for the afflicted medial personnel, but can also lead to lost time and disability, which is costly to both the employer and the employee.

Similarly, in the hospitality industry, housekeeping staff perform tasks daily that involve the physical exertion of bending and lifting, such as changing bed linens, wherein the housekeeping staff must bend their backs and lift heavy mattress repeatedly in order to change the linens and tuck them neatly into place. Reports of related injuries, lost time and disability associated with performing the above tasks are widely known.

There is a clear need for a simple, inexpensive and highly effective device to assist medical personnel and housekeeping staff in the performance of their duties while minimizing the risk of injury associated with the required tasks. This need is also clearly extended to numerous other industries that involve lifting and moving heavy and/or bulky objects, which impose similar strains on the performance personnel.

The use of pressurized fluid-filled vertical lifting or horizontal transfer devices has been known. Such devices are disclosed, for example, in U.S. Pat. No. 7,028,350 to Davis, U.S. Pat. No. 6,199,827 to Rimington et al., U.S. Pat. No. 4,417,639 to Wegener and U.S. Pat. No. 4,099,276 to Hunt et al. Another device is U.S. Pat. No. 7,725,963 to Johnson, which provides horizontal movement of a patient or object using a pressurized fluid-filled transfer pad that generates a controlled fluid film that lifts and enables horizontal movement of the pad.

However, the specific features of the transfer devices according to the present invention, and the unique combinations thereof described in more detail below, are not provided in conjunction with any single prior art lifting and transfer device. The present invention thus represents a significant improvement over the heretofore known lifting and transfer devices by providing low pressure fluidized devices that perform horizontal and/or vertical transfer operations, improve effective lifetime and overall operational efficiency of the device, reduce costs and reduce the potential for injuries and damage.

SUMMARY OF THE INVENTION

It is an object of the present invention to provide a simple, inexpensive and highly effective lifting and transfer device to assist medical personnel, housekeeping staff, and other laborers in the performance of their duties, which otherwise impose strains on the performance personnel, while minimizing the risk of injury associated with the required tasks and damage to the patients or objects being moved.

According to a first embodiment of the present invention, a transfer pad is provided, comprising a top sheet having an upper surface, a lower surface and a substantially rectangular outer peripheral shape, the top sheet having a width dimension extending in a transverse direction from a first outer peripheral side to an opposed second outer peripheral side thereof, and a length dimension extending in a longitudinal direction from a first outer peripheral end to an opposed second outer peripheral end thereof, and a bottom sheet having an upper surface, a lower surface and a substantially rectangular outer peripheral shape, the bottom sheet having a width dimension extending in the transverse direction from a first outer peripheral side to an opposed second outer peripheral side thereof and a length dimension extending in the longitudinal direction from a first outer peripheral end to an opposed second outer peripheral end thereof. The bottom sheet is joined to the top sheet to define a plenum chamber between the lower surface of the top sheet and the upper surface of the bottom sheet, the plenum chamber having a curved but substantially rectangular outer peripheral shape with rounded corners, a plenum chamber width dimension that is smaller than the respective width dimensions of the top and bottom sheets extending in the transverse direction and a plenum chamber length dimension that is smaller than the respective length dimensions of the top and bottom sheets extending in the longitudinal direction. A portion of the bottom sheet defining the plenum chamber is perforated in an area corresponding to a footprint of a load receiving portion of the top sheet and includes at least a central portion of the bottom sheet defining the plenum chamber.

The width dimension of the bottom sheet is selected so that the width of the portion of the bottom sheet defining the plenum chamber (i.e., the width between the junction points with the top sheet) is greater than the top sheet width in the corresponding area defining the plenum chamber to provide sufficient slack so as to be able to form pontoons defining the fluid weir structure, described below. It should be understood that the greater the width, the greater the slack, and the greater the pontoon height, which results in an increased fluid film area when a load is positioned on the transfer pad and improves ease of movement.

The transfer pad also includes a central membrane having an upper surface and a lower surface, a length dimension that is smaller than the plenum chamber length dimension and a width dimension that is smaller than the plenum chamber width dimension, wherein the central membrane is disposed within the plenum chamber and extends across a portion of the width of the plenum chamber and along a portion of the length of the plenum chamber. Transversely opposed areas of the upper surface of the central membrane proximate side edges thereof are affixed to portions of the lower surface of the top sheet along the length of the central membrane, and an area of the central membrane, including at least a portion of a longitudinal centerline of the central membrane that divides the width dimension of the central membrane into two equal parts, is affixed to a portion of the upper surface of the bottom sheet.

The transfer pad further includes a fluid weir, defined by outer peripheral portions of the lower surface of the bottom sheet defining the plenum chamber, and substantially surrounding the perforated portion of the bottom sheet defining the plenum chamber along with a fluid reservoir located between at least a central portion of the lower surface of the bottom sheet defining the plenum chamber and a surface on which the transfer pad is positioned.

Preferably, the transfer pad includes a rigid fluid inlet valve positioned at least at one of the rounded corners of the plenum chamber and extending a distance into the plenum chamber at an acute angle with respect to the longitudinal centerline of the plenum chamber. More preferably, the acute angle is 45°. Orienting the fluid inlet port in this manner aids in controlling the directionality of the fluid as it enters the plenum chamber and serves to reduce stresses and pressure by avoiding a straight line-of-sight impact between the pressurized inflowing fluid and opposed sidewalls of the plenum chamber. In that manner, the fluid flow is directed in an arc around the outer ring of the plenum chamber that circumscribes the plenum chamber sections defined by the affixed portions of central membrane, the top sheet and the bottom sheet.

It is also preferred that the transfer pad includes a plurality of peripheral flaps extending from the plenum chamber and defined between peripheral sides of the plenum chamber and respective peripheral edges of the top sheet and the bottom sheet. The location of these peripheral flaps also serves to reduce stress when translocating a load positioned on the top surface of the top sheet of the transfer pad, because the forces exerted on the transfer pad do not inhibit the area of the fluid film reservoir thereunder and enable the transfer pad to efficiently glide on the fluid film contained by the fluid weir when outward parallel forces are applied to the peripheral flaps. It is further preferred that one or more of the peripheral flaps includes at least one handle portion defined by at least one of an opening formed in the peripheral flap itself and a separate handle device affixed to the peripheral flap directly or through an opening.

According to one aspect of the present invention, it is preferred that a portion of the top sheet is peripherally fixed onto a portion of itself at a first fixation location to define an upper surface portion and distinct sidewall portions of the transfer pad, wherein the peripheral edges of the sidewall portions of the top sheet are joined to the bottom sheet. According to another aspect of the present invention, it is also preferred that a second portion of the top sheet is peripherally fixed onto a portion of itself, in a second fixation location, between the first fixation location and the peripheral edges of the top sheet, to define accordion sidewall portions of the transfer pad.

For aspects of the present invention including such peripheral flaps, it is particularly preferable that the overall width of the top sheet is greater than the overall width of the bottom sheet. This is particularly important for embodiments where the peripheral flaps extending from the plenum chamber and defined between peripheral sides of the plenum chamber and peripheral edges of the top sheet include portions of the top sheet fixed to itself and spaced a distance away from the peripheral edges of the top sheet, whereby a sidewall portion of the transfer pad is defined between the terminal edge of the extended fixation portion and the peripheral edges of the top sheet, which are joined to the bottom sheet.

It is also preferred that the areas of the upper surface of the central membrane that are affixed to portions of the lower surface of the top sheet and the area of the lower surface of the central membrane that is affixed to a portion of the upper surface of the bottom sheet are large enough to disperse the pressure thereon when the pressurized fluid is introduced into the plenum chamber and to disperse the pressure across the area so as to prevent tearing or other catastrophic structural damage.

According to a second embodiment of the present invention, a transfer pad is provided, comprising a top sheet having an upper surface, a lower surface and a substantially rectangular outer peripheral shape, the top sheet having a width dimension extending in a transverse direction from a first outer peripheral side to an opposed second outer peripheral side thereof, and a length dimension extending in a longitudinal direction from a first outer peripheral end to an opposed second outer peripheral end thereof, and a bottom sheet having an upper surface, a lower surface and a substantially rectangular outer peripheral shape, the bottom sheet having a width dimension extending in the transverse direction from a first outer peripheral side to an opposed second outer peripheral side thereof and a length dimension extending in the longitudinal direction from a first outer peripheral end to an opposed second outer peripheral end thereof.

The transfer pad also includes one or more interior sheets, each having an upper surface, a lower surface and a substantially rectangular outer peripheral shape, a width dimension extending in the transverse direction from a first outer peripheral side to an opposed second outer peripheral side thereof, and a length dimension extending in the longitudinal direction from a first outer peripheral end to an opposed second outer peripheral end thereof. The outer peripheral sides and the outer peripheral ends of the one or more interior sheets are joined to the outer peripheral sides of at least one of the top sheet, the bottom sheet and an adjacent interior sheet to define an accordion sidewall structure extending between the top and bottom sheets around the outer peripheral shape of the transfer pad and defining a main plenum chamber therein. A plurality of adjacent plenum chamber sections are defined between respective ones of the top sheet, the interior sheets and the bottom sheet.

According to one aspect of this embodiment of the present invention, a central opening, having a major dimension extending along the longitudinal direction and a minor dimension extending in the transverse direction, is provided in at least one of the top sheet, the one or more interior sheets, and the bottom sheet.

Preferably, at least portion of each of the one or more interior sheets includes a damping section defining a predetermined area to provide fluid communication between adjacent vertical plenum chamber sections. More preferably, each damping section comprises a plurality or perforations provided in the predetermined area. Preferably, the damping sections are centrally located between the outer peripheral sides of the interior sheets and the central opening in both the longitudinal and transverse directions. A preferred ratio of the amount of damping area with respect to the total area of each section of the interior sheet is 1/3 solid, 2/3 perforated to define the damping sections.

According to another aspect of this embodiment of the present invention, a portion of the bottom sheet is perforated in an area corresponding to a footprint of a load receiving portion of the top sheet and includes at least a central portion of the bottom sheet, whereby a fluid weir, defined by outer peripheral portions of the lower surface of the bottom sheet is provided, substantially surrounding the perforated portion of the bottom sheet, along with a fluid reservoir located between at least a central portion of the lower surface of the bottom sheet and a surface on which the transfer pad is positioned.

It is also preferred that a fluid inlet port is provided, located on a portion of the accordion sidewall proximate the bottom sheet at one or both ends of the transverse ends of the transfer pad.

It is further preferable that the transfer pad also includes a discrete inflatable columnar insert member, having a variable height dimension and fixed length and width dimensions, which substantially correspond to the length and width of the central opening so as to fit therein, is positioned within the central opening to provide added rigidity and/or to serve as a pivot point for turning a load positioned on the top sheet of the transfer pad when the bottom sheet is perforated to provide a fluid film thereunder. That is, when the discrete inflatable columnar insert member, which defines one plenum chamber, is pressurized along with the outer plenum chamber, the mutual expansion of these structures against one another creates a rigid support column.

According to a third embodiment of the present invention, a horizontal and vertical transfer pad is provided, comprising a vertical transfer portion and a horizontal transfer portion.

The vertical transfer portion comprises a top sheet having an upper surface, a lower surface and a substantially rectangular outer peripheral shape, the top sheet having a width dimension extending in a transverse direction from a first outer peripheral side to an opposed second outer peripheral side thereof, and a length dimension extending in a longitudinal direction from a first outer peripheral end to an opposed second outer peripheral end thereof, a bottom sheet having an upper surface, a lower surface and a substantially rectangular outer peripheral shape, the bottom sheet having a width dimension extending in the transverse direction from a first outer peripheral side to an opposed second outer peripheral side thereof and a length dimension extending in the longitudinal direction from a first outer peripheral end to an opposed second outer peripheral end thereof, and one or more interior sheets, each having an upper surface, a lower surface and a substantially rectangular outer peripheral shape, a width dimension extending in the transverse direction from a first outer peripheral side to an opposed second outer peripheral side thereof, and a length dimension extending in the longitudinal direction from a first outer peripheral end to an opposed second outer peripheral end thereof.

The outer peripheral sides and the outer peripheral ends of the one or more interior sheets are joined to the outer peripheral sides of at least one of the top sheet, the bottom sheet and an adjacent interior sheet to define an accordion sidewall structure extending between the top and bottom sheets around the outer peripheral shape of the transfer pad and defining a main plenum chamber therein.

A plurality of adjacent plenum chamber sections are defined between respective ones of the top sheet, the interior sheets and the bottom sheet, and at least portion of each of the one or more interior sheets includes a damping section defining a predetermined area to provide fluid communication between adjacent vertical plenum chamber sections.

The horizontal transfer section comprises a first sheet defined by the bottom sheet of the vertical transfer section, a second sheet having an upper surface, a lower surface and a substantially rectangular outer peripheral shape, the second sheet having a width dimension extending in the transverse direction from a first outer peripheral side to an opposed second outer peripheral side thereof and a length dimension extending in the longitudinal direction from a first outer peripheral end to an opposed second outer peripheral end thereof, wherein the second sheet is joined to the first sheet to define a plenum chamber section between the lower surface of the first sheet and the upper surface of the second sheet, the plenum chamber section having a curved but substantially rectangular outer peripheral shape with rounded corners, a plenum chamber section width dimension that is smaller than the width dimension of at least the first sheet extending in the transverse direction and a plenum chamber section length dimension that is smaller than the length dimension of at least the top extending in the longitudinal direction.

A portion of the second sheet defining the plenum chamber is perforated in an area corresponding to a footprint of a load receiving portion of the top sheet of the vertical transfer section, which includes at least a central portion of the second sheet. The horizontal transfer section also includes a central membrane having an upper surface and a lower surface, a length dimension that is smaller than the plenum chamber section length dimension and a width dimension that is smaller than the plenum chamber section width dimension, wherein the central membrane is disposed within the plenum chamber section and extends across a portion of the width of the plenum chamber section and along a portion of the length of the plenum chamber section, wherein transversely opposed areas of the upper surface of the central membrane proximate side edges thereof are affixed to portions of the lower surface of the first sheet along the length of the central membrane, and wherein an area including at least a portion of a longitudinal centerline of the central membrane, which divides the width dimension of the central membrane into two equal parts, is affixed to a portion of the upper surface of the second sheet. A fluid weir, defined by outer peripheral portions of the lower surface of the second sheet and substantially surrounding the perforated portion of the second sheet is provided, along with a fluid reservoir located between at least a central portion of the lower surface of the second and a surface on which the vertical and horizontal transfer pad is positioned.

One beneficial feature attributed to the present invention is that the transfer pads can be made using only a few sheets, for example, as little as three, which requires less material overall and reduces costs. The number of discrete sealing points that must be formed is reduced, which, in turn, reduces the complexity and number of required manufacturing steps, which also reduces costs. The transfer pads can be reused and be easily and compactly folded for storage. Conversely, it is equally convenient that the transfer pads according to the present invention can be readily disposed of by incineration or biodegradation, or other suitable means.

The transfer pad according to the first embodiment provides mainly horizontal translocation of a patient or object positioned thereon, and the transfer pad according to the second embodiment provides mainly vertical and/or pivoting translocation of the patient or object thereon. These two embodiments can be utilized separately for different applications, or in conjunction with one another to effectuate all three types of translocation for a single object or patient. The transfer pad according to the third embodiment includes both a vertical translocation portion and a horizontal translocation portion, and can be formed as an assembled unit or a unitary structure.

For example, the transfer pad according to the first embodiment can be used by healthcare professionals in connection with translocating patients between placement surfaces, such as gurney to operating table or recovery bed, ground to gurney, or ground gurney to ambulance deck. These tasks can be easily performed using the transfer pad according to the first embodiment without subjecting the healthcare provider to injurious conditions or risking the safety and well being of the patient.

In addition, the transfer pad according to the second embodiment of the present invention can be located under a standard mattress in a hotel or motel, and can be inflated to lift and/or turn the mattress to a comfortable height/orientation to facilitate the linen changing operations. There are numerous industrial applications for the transfer pad according to the present invention that involve the vertical movement of objects that are otherwise too heavy to safely move, or which require positioning at a height that cannot be safely achieved without risking injury to the task performer.

The transfer pad according to the third embodiment can perform lifting, pivoting and horizontal translocation in conjunction with a single device, which runs off a fluid supply source such as a hand-held portable air blower unit. In fact, all of the embodiments according to the present invention can be inflated and used in conjunction with such a small and portable (preferably battery operated and un-corded) pressurizing unit. This adds to the portability and reliability of the devices, which are not necessarily dependent upon an external power source when the portable blower is battery-powered.

BRIEF DESCRIPTION OF THE DRAWINGS

For a better understanding of the present invention, reference should be made to the following detailed description of preferred embodiments, read in connection with the accompanying drawings, in which:

FIG. 1C2 is a perspective partial sectional view;

FIG. 1F2 is a perspective partial sectional view;

FIG. 2B2 is a perspective partial sectional view;

FIG. 2E2 is a perspective partial sectional view;

FIG. 2F is a cross-sectional view of another transfer pad 10B2 according to another aspect of the first embodiment of the present invention, illustrating an example of how the top sheet is fixed onto itself in different locations to form an accordion side-wall structure;

FIG. 2G is a cross-sectional view of another transfer pad 10B3 according to another aspect of the first embodiment of the present invention, illustrating an example of how the top sheet is fixed to the bottom sheet without forming an extending side-wall structure;

FIG. 2H is a semi-flattened perspective top view of a transfer pad 10C according to another aspect of the first embodiment of the present invention, illustrating an example of the provision and position of handle means on the peripheral flaps of the transfer pad 10B;

FIG. 2I is an un-inflated perspective top view of a transfer pad 10D according to another aspect of the first embodiment of the present invention, illustrating another example of the provision and position of handle means on the peripheral flaps of the transfer pad 10B and including an accessory member retaining strap;

FIG. 2J is a schematic view showing an example of retaining means adapted to engage the handle means on the transfer pad 10D;

FIG. 6K schematically shows the position of the damping sections 139 on an interior sheet 132*a* for the transfer pad 100A;

DETAILED DESCRIPTION OF THE INVENTION

Figure 1A:
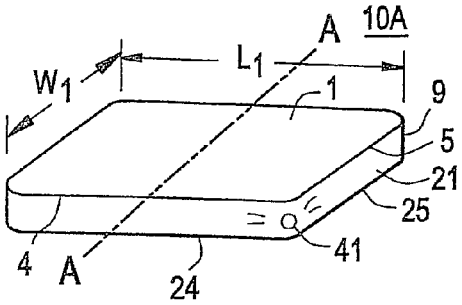
FIG. 1A is a perspective top view of a transfer pad 10A according to one aspect of the first embodiment of the present invention in an un-inflated state, expanded upwardly to better illustrate the structural features.
Figure 1B:
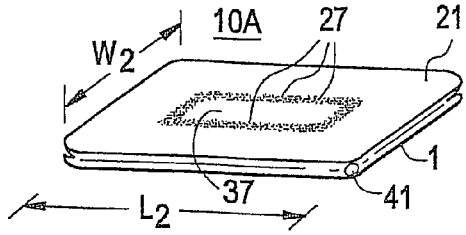
FIG. 1B is a perspective bottom view of the transfer pad 10A in an un-inflated, flattened state.
Figure 1C:
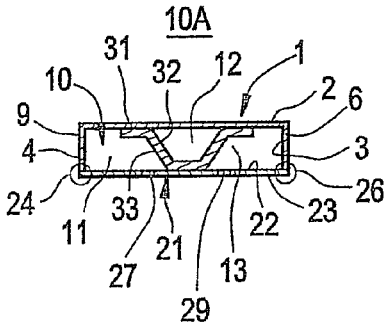
FIG. 1C is a cross-sectional view of the transfer pad 10A taken through line A-A in FIG. 1A.
Figure 1C:
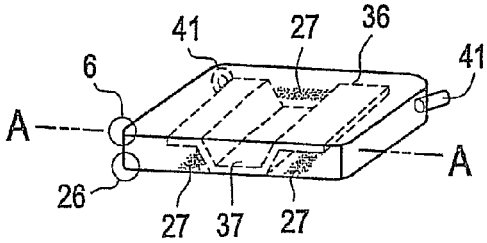
Figure 1D:
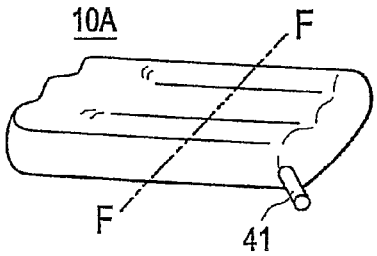
FIG. 1D is a perspective top view of the transfer pad 10A in FIG. 1A shown in an inflated state.
Figure 1E:
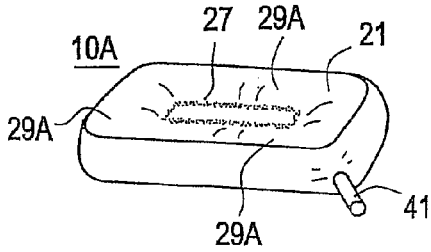
FIG. 1E is a perspective bottom view of the transfer pad 10A in FIG. 1A shown in an inflated state.
Figure 1F:
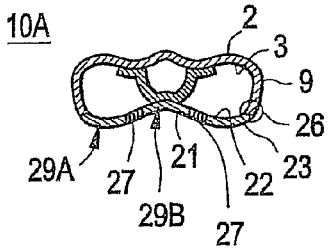
FIG. 1F is a cross-sectional view of the transfer pad 10A taken through line F-F in FIG. 1C.
Figure 1F:
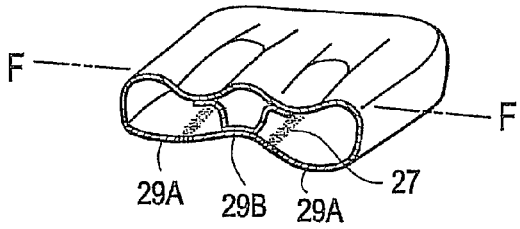

FIG. 1A is a perspective top view of a transfer pad 10A according to one aspect of the first embodiment of the present invention in an un-inflated state, expanded upwardly to better illustrate the structural features, FIG. 1B is a perspective bottom view of the transfer pad 10A in an un-inflated, flattened state, FIG. 1C is a cross-sectional view of the transfer pad 10A taken through line A-A in FIG. 1A, and FIG. 1C2 is a perspective partial sectional view. FIG. 1D is a perspective top view of the transfer pad 10A in FIG. 1A shown in an inflated state, FIG. 1E is a perspective bottom view of the transfer pad 10A in FIG. 1A shown in an inflated state, FIG. 1F is a cross-sectional view of the transfer pad 10A taken through line F-F in FIG. 1C, and FIG. 1F2 is a perspective partial sectional view.

The transfer pad 10A includes a top sheet having 1 an upper surface 2, a lower surface 3 and a substantially rectangular outer peripheral shape. The top sheet 1 has a width dimension $W_1$ extending in a transverse direction between outer peripheral, longitudinal side edges 4, and a length dimension $L_1$ extending in a longitudinal direction between outer peripheral end edges 5. The transfer pad 10A also includes a bottom sheet 21 having an upper surface 22, a lower surface 23 and a substantially rectangular outer peripheral shape. The bottom sheet 21 has a width dimension $W_2$ extending in the transverse direction between the outer peripheral side edges 24 and a length dimension $L_2$ extending in the longitudinal direction between outer peripheral end edges 25.

Suitable examples of materials from which the top sheet 1 and the bottom sheet 21 are constructed include, but are not limited to, polyurethane, PVC, nylon, suitable fluid-tight paper-polymer composite materials, TYVEK and other suitable spun-bound fiber materials, and other composites having suitable fluid-tight and biodegradability characteristics. The nature of the material from which these sheets are constructed must be sufficient to retain the pressurized fluid within the plenum chamber 10 of the transfer pad 10A without unwanted losses, and is also preferably sufficiently flexible so as to enable the transfer pad to be folded into a compact shape for convenient storage, even in places such as ambulances where there is typically a shortage of storage real estate. According to one aspect of the present invention, the material of the sheets is preferably inexpensive and has characteristics which enable the sheets to be biodegradable or readily disposed of by incineration, for example, without releasing any toxic substances thereupon, so as to impart a disposable nature to the transfer pad. Examples of such disposable materials include, but are not limited to, polyurethane, PVC, nylon, suitable fluid-tight paper-polymer composite materials, TYVEK and other suitable spun-bound fiber materials, and other composites having suitable fluid-tight and biodegradability characteristics.

The bottom sheet 21 is joined to the top sheet 1 at peripheral junction 26 to define a plenum chamber 10 between the lower surface 3 of the top sheet 1 and the upper surface 22 of the bottom sheet 21. The peripheral side edges 4 and the end edges 5 (not shown) constitute the portions of the top sheet 1 that are joined to the upper surface 22 of the bottom sheet 21 along the junction 26. The peripheral junction 26 can be effectuated by means such as localized heat sealing, seam-line sealing or any other suitable means that will not compromise the fluid-tight nature of the plenum chamber 10 defined thereby.

As shown in FIGS. 1A and 1C, according to one aspect of the present invention, portions of the top sheet 1 are attached onto itself at a junction 6 to define sidewalls 9. The sidewalls 9 provide structural stability and control the dimensional degree to which the plenum chamber can expand in the vertical direction to define the height of the plenum chamber 10. The junction 6 can be formed by a localized heat sealing, seam-line sealing, or any other means sufficient to create the required junction while retaining the fluid-tight qualities required of the top sheet in conjunction with its function in defining the plenum chamber 10.

The plenum chamber 10 has a rounded but substantially rectangular outer peripheral shape with rounded corners, a plenum chamber width dimension $W_{pc}$, which is smaller than the respective width dimensions of the top 1 and bottom 21 sheets, extending in the transverse direction, and a plenum chamber length dimension $L_{pc}$, which is smaller than the respective length dimensions of the top 1 and bottom 21 sheets, extending in the longitudinal direction. The provision of rounded peripheral edges corners eliminates stress concentration points typically generated at right-angle junctions, for example, and is important with respect to reducing the stresses placed upon the structures of the transfer pad 10A. The plenum chamber 10 also includes plenum chamber sections 11, 12 and 13, which are in fluid communication with the overall plenum 10 at least the periphery thereof.

A portion of the bottom sheet 21 defining the plenum chamber 10 is perforated in an area 27 corresponding to a footprint of a load receiving portion of the top sheet 1 and which surrounds a central portion of the bottom sheet 21 defining the plenum chamber 10 in a location corresponding to an area 37 where the central membrane 31 (discussed in more detail below) is attached to the bottom sheet 21 (see, e.g., FIG. 1B). The perforated area 27 is confined in this manner in order to accommodate the provision of a fluid weir 29A surrounding a fluid reservoir 29B, which receives the pressurized fluid through the perforations in the perforated area 27 (see, e.g., FIG. 1F) to create the fluid film on which the transfer pad 10A translocates in a reduced friction manner.

The transfer pad 10A also includes a central membrane 31 having an upper surface 32 and a lower surface 33, a length dimension $L_3$, which is smaller than the plenum chamber length dimension, and a width dimension $W_3$, which is smaller than the plenum chamber width dimension. The central membrane 31 is disposed within the plenum chamber 10 and extends across a portion of the width of the plenum chamber and along a portion of the length of the plenum chamber. Transversely opposed areas 36 of the upper surface of the central membrane 31 proximate longitudinal side edges 34 thereof are affixed to portions of the lower surface 3 of the top sheet 1 along the length of the central membrane 31, and a central area 37 of the central membrane 31, including at least a portion of a longitudinal centerline of the central membrane 31 that divides the width dimension of the central membrane into two equal parts, is affixed to a portion of the upper surface 22 of the bottom sheet 21.

The transfer pad further includes a fluid weir 29A, defined by outer peripheral portions of the lower surface 23 of the bottom sheet 21 defining the plenum chamber 10, and substantially surrounding the perforated portion 27 of the bottom sheet 21 defining the plenum chamber 10, along with a fluid reservoir 29B located between at least a central portion of the lower surface 23 of the bottom sheet 21 defining the plenum chamber 10 and a surface (e.g., a planar surface) on which the transfer pad 10A is positioned.

The areas 36 and 37 over which the central membrane 31 is affixed to the top sheet 1 and the bottom sheet 21 serve to constrict the vertical expansion of the plenum chamber 10 when the pressurized fluid is introduced. In that manner, a pillowing effect is created with respect to the top sheet 1 to comfortably accommodate and stably retain a patient of a load thereon, and the fluid reservoir 29B and fluid weir 29A are created, whereby the fluid weir 29B substantially traps the pressurized fluid expelled through the perforated area 27 within the fluid reservoir 29B to create the fluid film on which the transport pad 10A translocates across the surface on which it is positioned.

The width and attachment areas of the central membrane 31, in connection with the dimension of the portion of the top sheet 1 defining the height of the side-walls 9 and the width of the portion of the bottom sheet defining the plenum chamber 10, determine the degree to which the pillowing effect and fluid weir/reservoir will be effectuated, as one skilled in the art should readily appreciate. A greater overall height of the plenum chamber, as constricted to form the pillows and weir/reservoir, will enable the transfer pad 10A to be translocated across surfaces which may not necessarily be perfectly planar in nature, such as transition points between load/patient placement surfaces, door jams, or other uneven surface situations. That is, the fluid film and the fluid film retaining ability of the weir will not be hampered by impediments to the same degree that would otherwise be experienced in a transfer mat having a lower plenum chamber height.

Figure 1G:
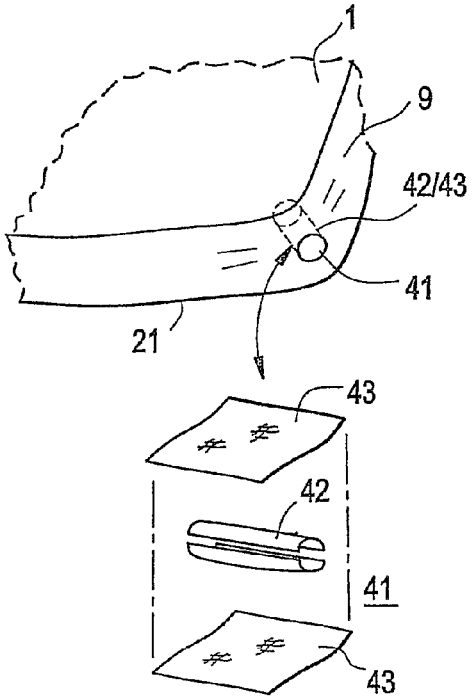
FIG. 1G is a partial perspective view of the transfer pad 10A shown in FIG. 1C and an exploded view of the inlet valve 41 according to the first embodiment of the present invention.

FIG. 1G is a partial perspective view of the transfer pad 10A shown in FIG. 1C and an exploded view of the inlet valve 41 according to the first embodiment of the present invention. The inlet valve 41 includes valve portions 42 arranged in a substantially cylindrical shape and sealed to one another, and support sheets 43 sealed around the valve portions 42 and affixed to a portion of the top sheet or a portion of the top sheet defining the sidewalls, and/or a portion of the bottom sheet for example. It is preferred that valves 41 are positioned at least at one rounded corner, and more preferably at every rounded corner, of the plenum chamber 10, and oriented at an acute angle with respect to the longitudinal centerline of the plenum chamber 10. In that manner, pressurized fluid can be introduced from any rounded corner portion of the plenum chamber 10 for added convenience, accounting for variations in applications and orientations of the transfer pad 10A, and controlling the angle at which the pressurized fluid is input controls the directionality of the fluid flow within the plenum chamber. According to the present invention, the angular nature of the valve orientation promotes an arc flow rather than a straight-line fluid flow upon input, thereby reducing stresses on the structure and improving the flow efficiency.

Figure 1H:
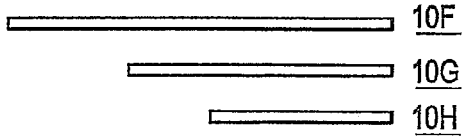
FIG. 1H is a schematic side view illustrating some examples of size variations associated with different applications of the transfer pad according to the first embodiment of the present invention.

FIG. 1H is a schematic side view of transfer pads 10F, 10G and 10H illustrating some examples of size variations associated with different applications of the transfer pad according to the first embodiment of the present invention. It should be clearly understood that the dimensional aspects of the transfer pad according to the various embodiments of the present invention van be adjusted to be larger or smaller, based on the desired application, without departing from the scope of the present invention.

Figure 1I:
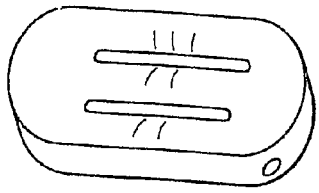
FIG. 1I is a perspective view illustrating one example of the curved nature of the substantially rectangular shape of the plenum chamber, which is a feature common to all aspects of the first embodiment of the present invention, although this curvature is not expressly shown in the other related drawings.

FIG. 1I is a perspective view illustrating one example of the curved nature of the substantially rectangular shape of the plenum chamber. This is a feature common with respect to all aspects of the first embodiment of the present invention, although this curvature at the ends is not necessarily expressly shown in the other related drawings. Preferably, the arc defining the degree of curvature is 180° so as to further reduce stresses on the structure when the pressurized fluid is introduced and present within the plenum chamber.

Figure 2A:
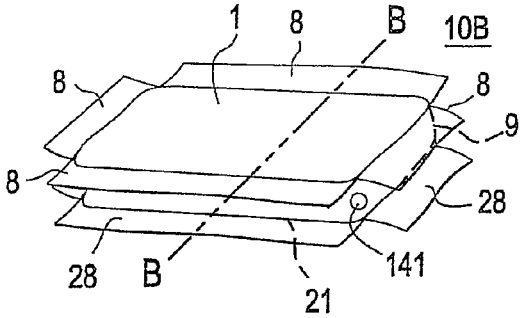
FIG. 2A is a perspective top view of a transfer pad 10B according to another aspect of the first embodiment of the present invention in an un-inflated state, expanded upwardly to better illustrate the structural features.
Figure 2B:
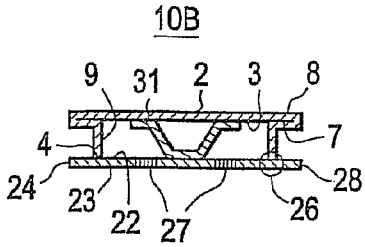
FIG. 2B is a cross-sectional view of the transfer pad 10B taken through line B-B in FIG. 2A.
Figure 2B:
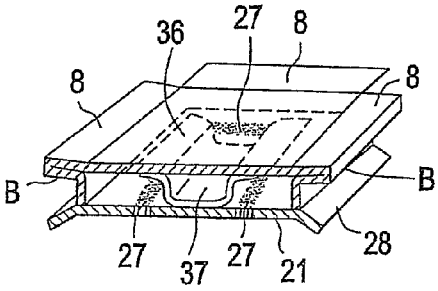
Figure 2C:
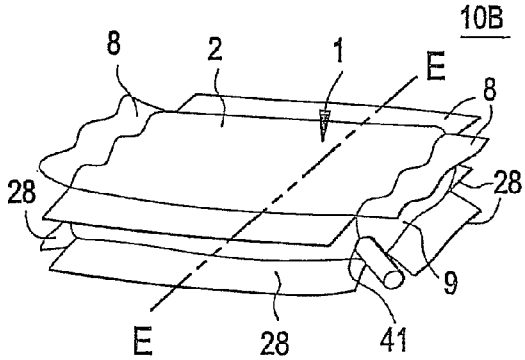
FIG. 2C is a perspective top view of the transfer pad 10B in FIG. 2A shown in an inflated state.
Figure 2D:
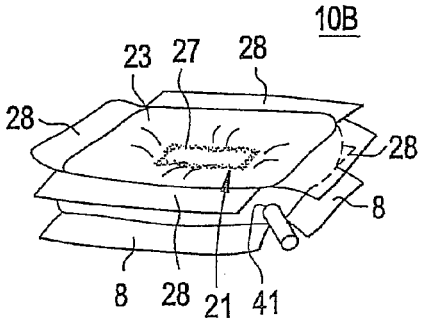
FIG. 2D is a perspective bottom view of the transfer pad 10B in FIG. 2A shown in an inflated state.
Figure 2E:
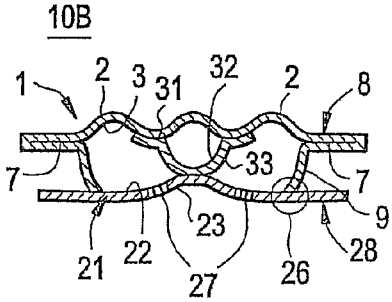
FIG. 2E is a cross-sectional view of the transfer pad 10B taken through line E-E in FIG. 2C.

FIG. 2A is a perspective top view of a transfer pad 10B according to another aspect of the first embodiment of the present invention in an un-inflated state, expanded upwardly to better illustrate the structural features, FIG. 2B is a cross-sectional view of the transfer pad 10B taken through line B-B in FIG. 2A, and FIG. 2B2 is a perspective partial sectional view. FIG. 2C is a perspective top view of the transfer pad 10B in FIG. 2A, shown in an inflated state, FIG. 2D is a perspective bottom view of the transfer pad 10B in FIG. 2A shown in an inflated state, FIG. 2E is a cross-sectional view of the transfer pad 10B taken through line E-E in FIG. 2C, and FIG.

2E2 is a perspective partial sectional view. Like reference numbers designate like elements, and repeat descriptions have been omitted.

The transfer pad 10B has the same basic structure as transfer pad 10A, but further includes a plurality of peripheral flaps 8, 28 defined by portions of the top sheet 1 and bottom sheet 21 extending from the plenum chamber. More specifically, the peripheral flaps 8, 28 are defined between peripheral sides of the plenum chamber and respective peripheral edges of the top sheet 1 and the bottom sheet 21. The location of these peripheral flaps 8, 28 also serves to reduce stress when translocating a load positioned on the top surface 2 of the top sheet 1 of the transfer pad 10B, because the forces exerted on the transfer pad 10B do not inhibit the area of the fluid film reservoir 29B thereunder, and enable the transfer pad 10B to efficiently glide on the fluid film contained by the fluid weir 29A when outward parallel forces are applied to the peripheral flaps 8, 28.

According to one aspect of the present invention, in order to define the peripheral flaps 8, it is preferred that a portion of the top sheet 1 is peripherally fixed onto a portion of itself at a first fixation location (e.g., junction 7 in FIG. 2E, for example) to define an upper surface portion and distinct sidewall portions 9 of the top sheet 1 of the transfer pad 10B, wherein the outer peripheral side and end edges 4, 5 of the top sheet are joined to the bottom sheet 21 at junction 26. As shown in FIG. 2F, another aspect of the present invention involves fixing a portion of the top sheet 1 in a location defining the sidewall 9 onto a portion of itself, in a second fixation location 7A, between the first fixation location 7 and the junction 26, to define accordion sidewall portions 9A of the transfer pad 10B2. This attribute provides a rigid beam along the sidewalls to further improve the structural integrity of the transfer pad, improving support and aiding in alignment.

It should be noted that, although it is not expressly shown in the drawings, such a second fixation location 7A could also be provided in connection with the embodiment shown in FIGS. 1C and 1F to define accordion sidewalls in embodiments without peripheral flaps. The provision of accordion sidewalls aids in the dispersion of fluid flow within the plenum chamber and serves to reduce physical stresses on the structure.

As shown in FIG. 2G, the transfer pad 10B3 involves fixing a portion of the top sheet 1 to the bottom sheet 21 at a peripheral junction 26, so ad to define a structure without distinct sidewall portions. This aspect is most useful in situations where the height of the plenum chamber is desired to be smaller, since less plenum chamber vertical expansion is effectuated according to this aspect.

As shown in FIGS. 2H-2J, is further preferred that one or more of the peripheral flaps 8, 28 include at least one handle portion defined by at least one of an opening formed 8A, 28A in the peripheral flap 8, 28 itself and a separate handle device 50 affixed to the peripheral flap 8, 28 directly or through an opening 8C. The number of different fastening devices that could be used for handles is not limited, and also includes, for example straps, ties, cover sheets, restrains and lift mechanisms.

FIG. 2H is a semi-flattened perspective top view of a transfer pad 10C according to another aspect of the first embodiment of the present invention, illustrating an example of the provision and position of handle means on the peripheral flaps of the transfer pad 10B. FIG. 2I is an un-inflated perspective top view of a transfer pad 10D according to another aspect of the first embodiment of the present invention, illustrating another example of the provision and position of handle means on the peripheral flaps of the transfer pad 10B and including an accessory member retaining strap, and FIG. 2J is a schematic view showing an example of retaining means adapted to engage the handle means on the transfer pad 10D.

As shown in FIG. 2H, the transfer pad 10C also includes holes as connection features 8B located proximate the corners of the peripheral flaps 8, 28. These holes 8B can be eyelet-type holes adapted for mating with hook portions of a hoist or other device so as to form a sling or otherwise lift the transfer pad 10C from diagonally opposed and/or directly opposed corners of the respective peripheral flaps.

Accessories, such as sanitary mats, air-filled mattresses or body boards, for example, can be used in conjunction with the transfer pad according to the first embodiment of the present invention to provide additional comfort and functionality features. The transfer pad 10D shown in FIG. 2I also includes an accessory member retaining strap 8D on the peripheral flap 8. The end edges of the accessory member retaining strap 8D are fixed to the peripheral strap 8 so that the length of the accessory member retaining strap 8D includes a small gap between the bottom surface thereof and the surface of the peripheral flap 8 to which it is attached, through which attachment portions of accessories can be inserted to secure the accessory member to the transfer pad, either above or below.

Figure 2K:
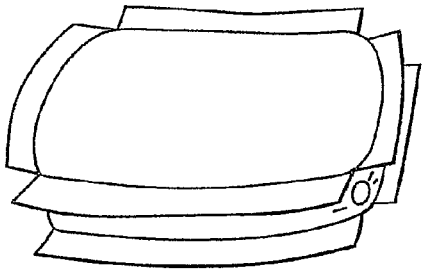
FIG. 2K is a perspective view illustrating one example of the curved nature of the substantially rectangular shape of the plenum chamber, which is a feature common to all aspects of the first embodiment of the present invention, although this curvature is not expressly shown in the other related drawings.

FIG. 2K is a perspective view illustrating one example of the curved nature of the substantially rectangular shape of the plenum chamber. This is a feature common with respect to all aspects of the first embodiment of the present invention, although this curvature at the ends is not necessarily expressly shown in the other related drawings. Preferably, the arc defining the degree of curvature is 180° so as to further reduce stresses on the structure when the pressurized fluid is introduced and present within the plenum chamber.

Figure 3A:
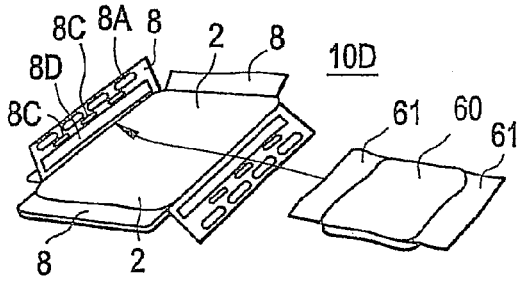
FIG. 3A is an un-inflated perspective top view of the transfer pad 10D, illustrating how an attachment portion of one example of an accessory member engages the accessory member retaining strap.
Figure 3B:
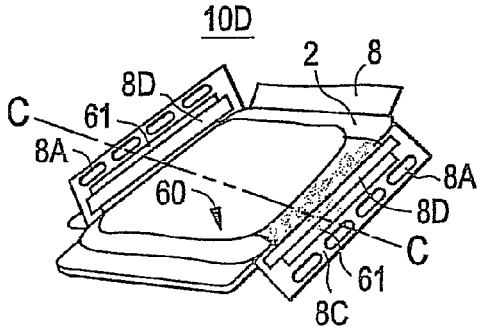
FIG. 3B is an un-inflated perspective top view of the transfer pad 10D, illustrating the accessory member engaged with the accessory member retaining strap an in position on the top sheet of the transfer pad to define a transfer pad-accessory member assembly.
Figure 3C:
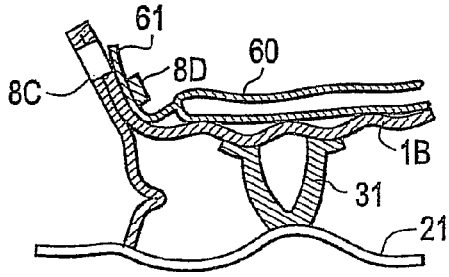
FIG. 3C is a partial cross-sectional view of the transfer pad-accessory member assembly taken through line C-C in FIG. 3B.

FIG. 3A is an un-inflated perspective top view of the transfer pad 10D, illustrating how an attachment portion 61 of one example of an accessory member 60, such a sanitary mat, engages the accessory member retaining strap 8D on the peripheral flap 8. FIG. 3B is an un-inflated perspective top view of the transfer pad 10D, illustrating the attachment portion 61 of the accessory member 60 engaged with the accessory member retaining strap 8D an in position on the top sheet 1 of the transfer pad 10D to define a transfer pad-accessory member assembly, and FIG. 3C is a partial cross-sectional view of the transfer pad-accessory member assembly taken through line C-C in FIG. 3B.

Figure 3D:
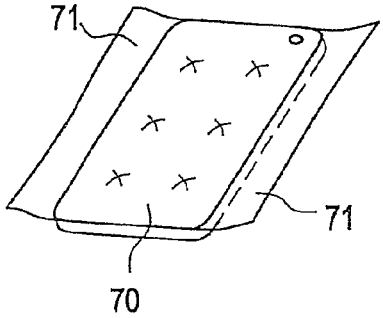
FIG. 3D is a perspective view of another example of an accessory member adapted to engage the transfer pad.
Figure 3E:
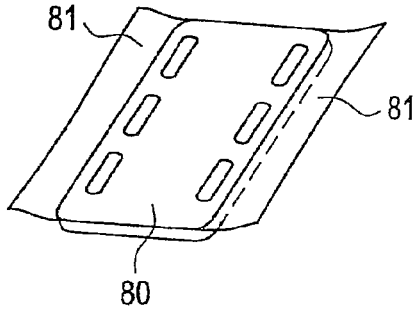
FIG. 3E is a perspective view of yet another example of an accessory member adapted to engage the transfer pad.

FIG. 3D is a perspective view of another example of an accessory member, such as an air-filled mattress 70, adapted to engage the transfer pad with attachment portions 71, and FIG. 3E is a perspective view of yet another example of an accessory member, such as body board 80, adapted to engage the transfer pad with attachment portions 8.

Figure 4A:
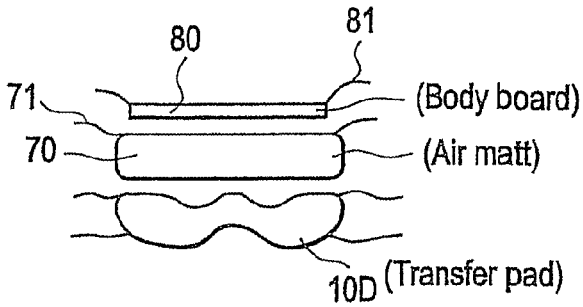
FIG. 4A is a schematic end view of one example of a transfer pad-accessory member assembly, including a combination of multiple accessory members.
Figure 4B:
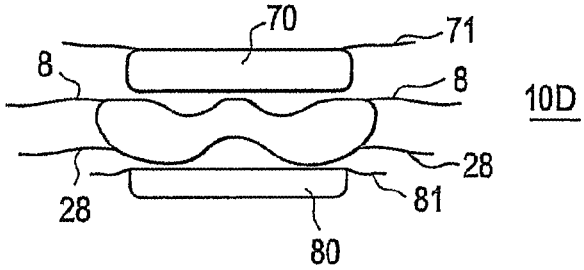
FIG. 4B is a schematic end view of another example of a transfer pad-accessory member assembly, including a different combination of multiple accessory members.

FIG. 4A is a schematic end view of one example of a transfer pad-accessory member assembly, including a combination of multiple accessory members. Specifically, the transfer pad-accessory member assembly in FIG. 4A includes a transfer pad 10D, an air-filled mattress 70 adapted to be attached to the upper surface thereof, and a body board 80 also adapted to be attached to the upper surface of the air-filled mattress 70. FIG. 4B is a schematic end view of another example of a transfer pad-accessory member assembly, including a different combination of multiple accessory members, wherein the body board 80 is located under the transfer pad 10D, and the air-filled mattress is positioned on top of the transfer pad 10D. It should be understood that the number and type of accessories that can be used in conjunction with the transfer pad according to the present invention can be readily determined based on the required application and situational constraints.

Figure 4C:
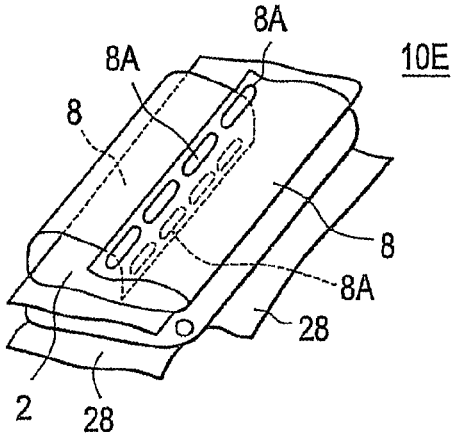
FIG. 4C is a perspective view of a transfer pad 10E according to another aspect of the present invention, including elongated peripheral straps adapted to engage one another to substantially enclose and retain a patient or load positioned on the load receiving surface of the transfer pad 10E.

FIG. 4C is a perspective view of a transfer pad 10E according to another aspect of the present invention, including elongated peripheral straps adapted to engage one another to substantially enclose and retain a patient or load positioned on the load receiving surface of the transfer pad 10E. This embodiment allows the patient or load to be secured on the transfer pad, and since the forces applied to effect the translocation are applied with respect to the lower peripheral flaps, no additional strain or constriction is applied to the patient or load.

Figure 5A:
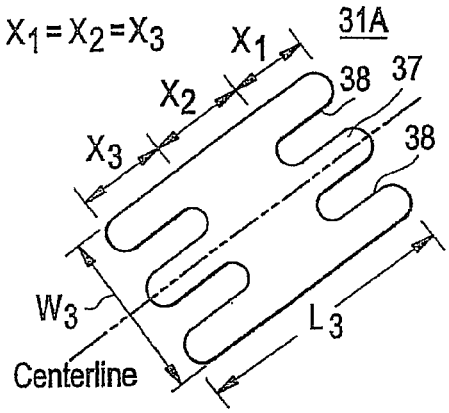
FIG. 5A is a schematic perspective view of one example of a center membrane according to one aspect of the first embodiment of the present invention.

FIG. 5A is a schematic perspective view of one example of a center membrane 31A according to one aspect of the first embodiment of the present invention. The center membrane 31A includes two rounded, elongate outer attachment areas 36 that are separated from the inner, rounded, elongate attachment area 37 by two rounded corner cut-out portions 38 at each end. This configuration helps reduce stresses on the structure. It is important to provide an attachment area that is sufficient to disperse the pressure thereacross when the pressurized fluid is introduced to the plenum chamber in order to reduce stresses and reduce the potential for tearing or other damage.

Figure 5B:
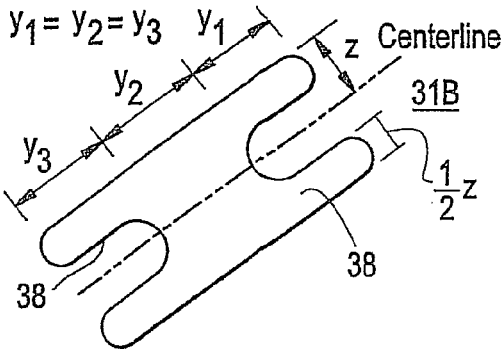
FIG. 5B is a schematic perspective view of another example of a center membrane according to the first embodiment of the present invention.

FIG. 5B is a schematic perspective view of another example of a center membrane 31B according to the first embodiment of the present invention. The center membrane 31B includes rounded elongate outer attachment areas 36 are separated from one another by one rounded corner cut-out portion 38 so as to sandwich a shorter, inner rounded, elongate attachment area 37. This configuration also helps reduce stresses on the structure.

Figure 5C:
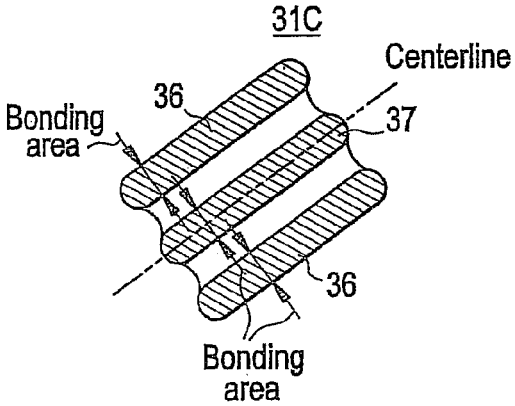
FIG. 5C is a schematic perspective view of another example of a center membrane according to the first embodiment of the present invention, used in connection with the examples of the transfer pads 10A-10E.

FIG. 5C is a' schematic perspective view of another example of a center membrane 31C according to the first embodiment of the present invention, which corresponds to the center membrane 31 shown and described in connection with the examples of transfer pads 10A-10E. The transverse edges of the center membrane 31C are rounded between the rounded, elongate attachment areas 36, 37, 36 to reduce stresses on the structure.

Figure 5D:
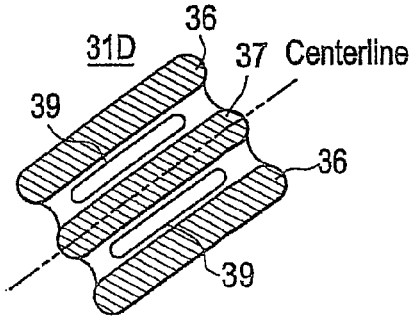
FIG. 5D is a schematic perspective view of yet another example of a center membrane according to the first embodiment of the present invention.

FIG. 5D is a schematic perspective view of yet another example of a center membrane according to the first embodiment of the present invention. The center membrane 31D also includes tow, rounded elongate openings 39 formed between attachment areas 36, 37, 36. The height of the plenum chamber can expand further by virtue of the provision of these openings 39, and can increase the pressure applied to corresponding portions of the top sheet if the transfer pad. It should be understood that the size and location of these openings can be modified as needed in view of any given application without departing from the scope of the present invention. For example, such openings can be positioned to correspond to heavier portions or an uneven load or patient, such as the hip region, to provide extra pressure and support at those locations.

Figure 5E:
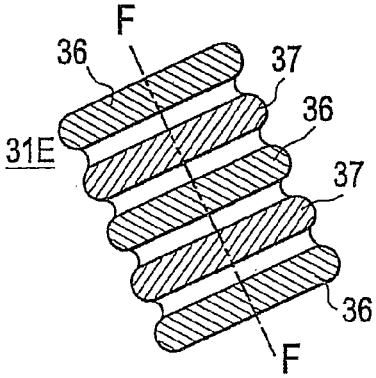
FIG. 5E is a schematic perspective view of still another example of a center membrane according to the first embodiment of the present invention, illustrating a structure that provides multiple top sheet cradling points, multiple bottom sheet weir portions surrounding two fluid reservoirs.
Figure 5F:
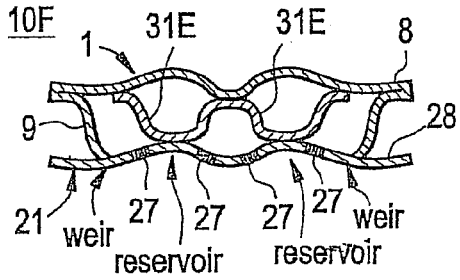
FIG. 5F is a cross-sectional view of a transfer pad 10F including the center membrane 31E from FIG. 5E, as taken through line F-F in FIG. 5E.

FIG. 5E is a schematic perspective view of still another example of a center membrane according to the first embodiment of the present invention, illustrating a structure that is adapted to provide multiple top sheet cradling points, multiple bottom sheet weir portions 29A surrounding two fluid reservoirs 29B, and FIG. 5F is a cross-sectional view of a transfer pad 10F including the center membrane 31E from FIG. 5E, as taken through line F-F in FIG. 5E. It should be readily appreciated that a larger fluid film area is needed to translocate larger transfer pads, and providing multiple fluid reservoirs in this manner aids in effectuating a larger fluid film to achieve the above objective. The number of pillowing sections and weir/reservoir sections is thus dictated by the application, and can be modified using multiple center membrane or a larger, singular center membrane without departing from the scope of the present invention.

Figure 6A:
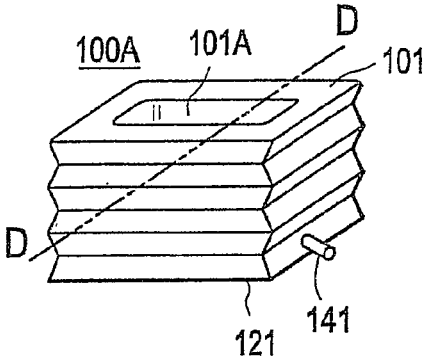
FIG. 6A is a perspective, top view of an example of a transfer pad 100A according to a second embodiment of the present invention, shown in an inflated state.
Figure 6B:
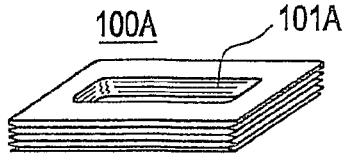
FIG. 6B is a perspective, top view of transfer pad 100A, shown in an un-inflated state.
Figure 6C:
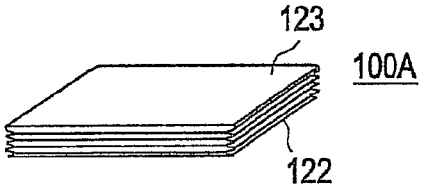
FIG. 6C is a perspective, bottom view of transfer pad 100A, shown in an un-inflated state.
Figure 6E:
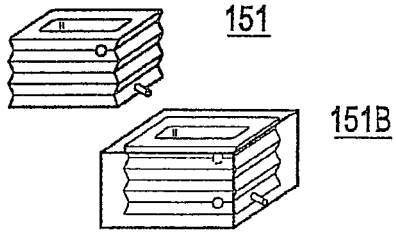
FIG. 6E includes perspective view of two examples of support column members that can be inserted, for example, into the central opening of transfer pad 100A, wherein one example includes an accordion-shaped support column member, and another example includes a combination structure incorporating the accordion-shaped support column member within, a flat-sided support column member.
Figure 6D:
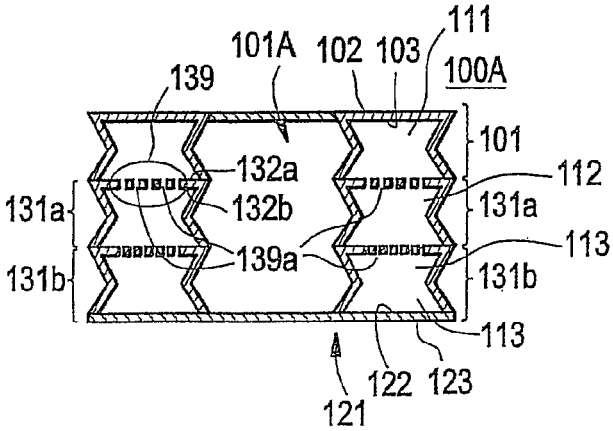
FIG. 6D is a cross-sectional view of transfer pad 100A taken through line D-D in FIG. 6A.

FIG. 6A is a perspective, top view of an example of a transfer pad 100A according to a second embodiment of the present invention, shown in an inflated state, FIG. 6B is a perspective, top view of transfer pad 100A, shown in an un-inflated state, FIG. 6C is a perspective, bottom view of transfer pad 100A, shown in an un-inflated state, and FIG. 6D is a cross-sectional view of transfer pad 100A taken through line D-D in FIG. 6A. The transfer pads according to the second embodiment of the present invention perform vertical and/or pivoting translocation of a patient or object positioned thereon, and are sometimes referred to herein as a jacking device or jacking portion.

The transfer pad 100A includes a top sheet 101 having an upper surface 102, a lower surface 103 and a substantially rectangular outer peripheral shape. The top sheet has a width dimension $W_4$ that extends in a transverse direction between opposed outer peripheral sides 104 thereof, and a length dimension $L_4$ that extends in a longitudinal direction between opposed outer peripheral ends 105 thereof. The transfer pad 100A also includes a bottom sheet 121 having an upper surface 122, a lower surface 123 and a substantially rectangular outer peripheral shape. The bottom sheet has a width dimension $W_5$ that extends in the transverse direction between opposed outer peripheral sides 124 thereof and a length dimension $L_5$ that extends in the longitudinal direction between opposed outer peripheral ends 125 thereof.

The transfer pad also includes one or more interior sheets 131*a*, 131*b*, each having an upper surface, a lower surface and a substantially rectangular outer peripheral shape, a width dimension extending in the transverse direction between opposed outer peripheral sides thereof, and a length dimension extending in the longitudinal direction from between opposed outer peripheral ends thereof. As shown in FIG. 6D, the outer peripheral sides (terminal side edges) and the outer peripheral ends (terminal end edges) of the one or more interior sheets 131*a*, 131*b* are joined to the outer peripheral sides of at least one of the top sheet 101, the bottom sheet 121 and an adjacent interior sheet 131 to define an accordion sidewall structure extending between the top 101 and bottom 121 sheets around the outer periphery of the transfer pad, and defining a main plenum chamber 110 therein. A plurality of adjacent plenum chamber sections 111, 112, 113 are defined between respective ones of the top sheet 101, the interior sheets 131*a*, 131*b* and the bottom sheet 121.

The transfer pad includes a central opening 101A, having a major dimension extending along the longitudinal direction and a minor dimension extending in the transverse direction, provided in at least one of the top sheet 101, the one or more interior sheets 131*a*, 131*b*, and the bottom sheet 121. As shown in FIGS. 6A-6D, the central opening 101A is provided in the top sheet 101 and the interior sheets 131*a*, 131*b*, but not the bottom sheet 121.

Each of the interior sheets 131*a*, 131*b* includes a damping section 139 defining a predetermined area to provide fluid communication between adjacent vertical plenum chamber sections 111, 112, 113. Each damping section comprises a plurality or perforations 139*a* provided in the predetermined area. Preferably, the damping sections 139 are centrally located between the outer peripheral sides and ends of the interior sheets and the central opening in both the longitudinal and transverse directions, as schematically shown in FIG. 6K. It is preferred that the bottom sheet 121 is a solid sheet to provide added peripheral dimensional stability and side-to-side and end-to-end rigidity to the inflated device.

The damping sections control the rate of inflation and deflation and control the fluid distribution across each plenum section and between vertically adjacent plenum sections so as to maintain as uniform a state as possible during both inflation and deflation to prevent tipping or uneven lifting/lowering of a load or patient positioned on the transfer pad. The size of the damping section controls the speed of inflation and deflation, whereby a larger damping section will enable faster inflation and deflation speeds.

It is further preferable that the transfer pad also includes a discrete inflatable columnar insert member, having a variable height dimension and fixed length and width dimensions, which substantially correspond to the length and width of the central opening so as to fit therein, is positioned within the central opening to provide added rigidity and/or to serve as a pivot point for turning a load positioned on the top sheet of the transfer pad 100A.

FIG. 6E includes perspective view of two examples of support column members that can be inserted, for example, into the central opening of transfer pad 100A, wherein one example 151 includes an accordion-shaped support column member, and another example 151B includes a combination structure incorporating the accordion-shaped support column member within a flat-sided support column member.

Figure 6F:
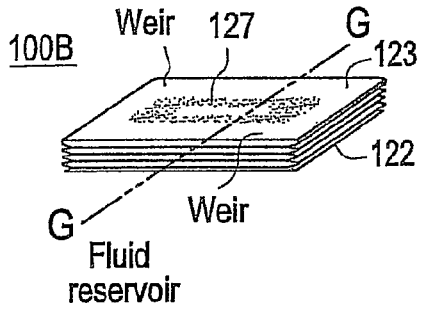
FIG. 6F is a bottom perspective view of a transfer pad 100B according to another aspect of the second embodiment of the present invention, shown in an un-inflated state.
Figure 6G:
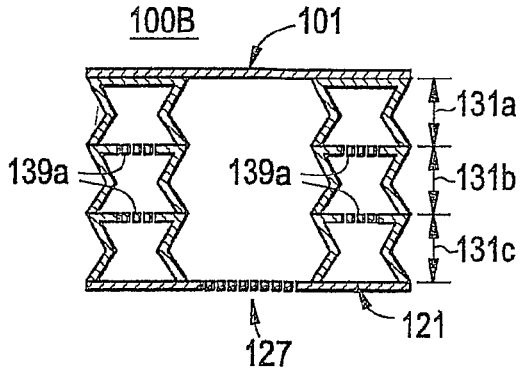
FIG. 6G is a cross-sectional view of transfer pad 100B, shown in an inflated state, as taken though line G-G in FIG. 6F.
Figure 6H:
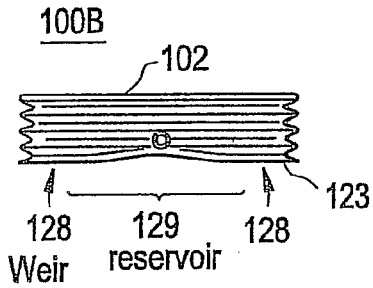
FIG. 6H is a schematic end view of the inflated transfer pad 100B.

Another aspect of this embodiment of the present invention is shown in FIGS. 6F-6H, wherein FIG. 6F is a bottom perspective view of a transfer pad 100B according to another aspect of the second embodiment of the present invention, shown in an un-inflated state, FIG. 6G is a cross-sectional view of transfer pad 100B, shown in an inflated state, as taken though line G-G in FIG. 6 and FIG. 6H is a schematic end view of the inflated transfer pad 100B.

In this aspect, the top sheet 101 does not necessarily include a central opening 101A, which is instead provided only in the interior sheets 131*a*, 131*b* and 131*c*. A portion of the bottom sheet 121 is perforated in an area 127 corresponding to a footprint of a load receiving portion of the top sheet 101 and includes at least a central portion of the bottom sheet, whereby a fluid weir 129A, defined by outer peripheral portions of the lower surface 123 of the bottom sheet 121 is provided, substantially surrounding the perforated area 127 of the bottom sheet 121, along with a fluid reservoir 129B located between at least a central portion of the lower surface 123 of the bottom sheet 121 and a surface on which the transfer pad 100A is positioned. If a central opening 101A is provided, the device having a perforated bottom sheet 121 is preferably used in conjunction with the lifting columns 151, 151B described above and shown in FIG. 6E.

It can be seen that, in each of the above-described aspects of the second embodiment of the present invention, a fluid inlet port 141 is provided, located on a portion of the accordion sidewall proximate the bottom sheet 121 at one or both ends of the longitudinally opposed ends of the transfer pad 100B.

Figure 6I:
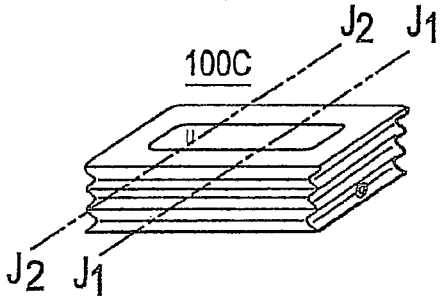
FIG. 6I is a perspective top view of a transfer pad 100C according to another aspect of the second embodiment of the present invention, shown in an inflated state.
Figure 6J:
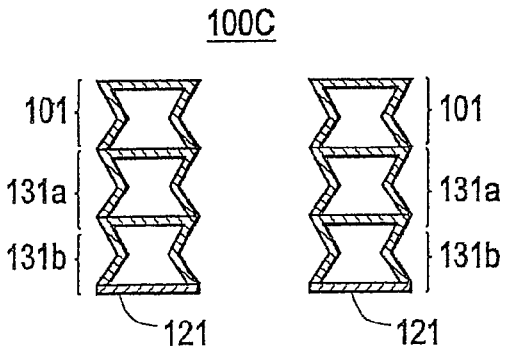
FIG. 6J is a cross-sectional slice of transfer pad 100C, taken through lines J1-J1 and J2-J2 in FIG. 6I.

FIG. 6I is a perspective top view of a transfer pad 100C according to another aspect of the second embodiment of the present invention, shown in an inflated state, and FIG. 6J is a cross-sectional slice of transfer pad 100C, taken through lines J1-J1 and J2-J2 in FIG. 6I. In this aspect, a central opening is provided in each of the top 101, interior 131*a*, 131*b* and bottom 121 sheets to provide a doughnut-like jacking ring.

Figure 7:
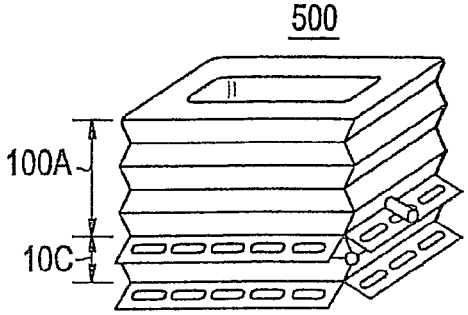
FIG. 7 is a perspective top view of a vertical and horizontal transfer assembly 500 according to a third embodiment of the present invention, including a combination of transfer pad 100A and transfer pad 10C.

FIG. 7 is a perspective top view of a vertical and horizontal transfer assembly 500 according to a third embodiment of the present invention, including one example of a combination of transfer pad 100A portion and transfer pad 10C portion. This embodiment can include separate devices 10C, 100A, or other respective variations thereof, which are externally joined to one another, or a unitary structure that shares a common solid sheet. For example, in an externally joined configuration, the bottom sheet 121 of the transfer pad 100A portion would be joined, at least peripherally with respect to the plenum chamber, to the top sheet 1 of the transfer pad 10C portion. According to an aspect having a unitary structure, the bottom sheet 121 of the transfer pad 100A portion would be the same member as the top sheet 1 of the transfer pad 10C portion.

It should be understood and appreciated that the assembly structure could be inverted, as well. For example, in an externally joined inverted configuration, the bottom sheet 21 of the transfer pad 10C portion would be joined, at least peripherally with respect to the plenum chamber, to the top sheet 101 of the transfer pad 100A portion. According to an inverted aspect having a unitary structure, the bottom sheet 21 of the transfer pad 10C portion would be the same member as the top sheet 101 of the transfer pad 100A portion. Other accessories can also be readily included with the assembly as described above in connection with the transfer pad according to the first embodiment.

Figure 8:
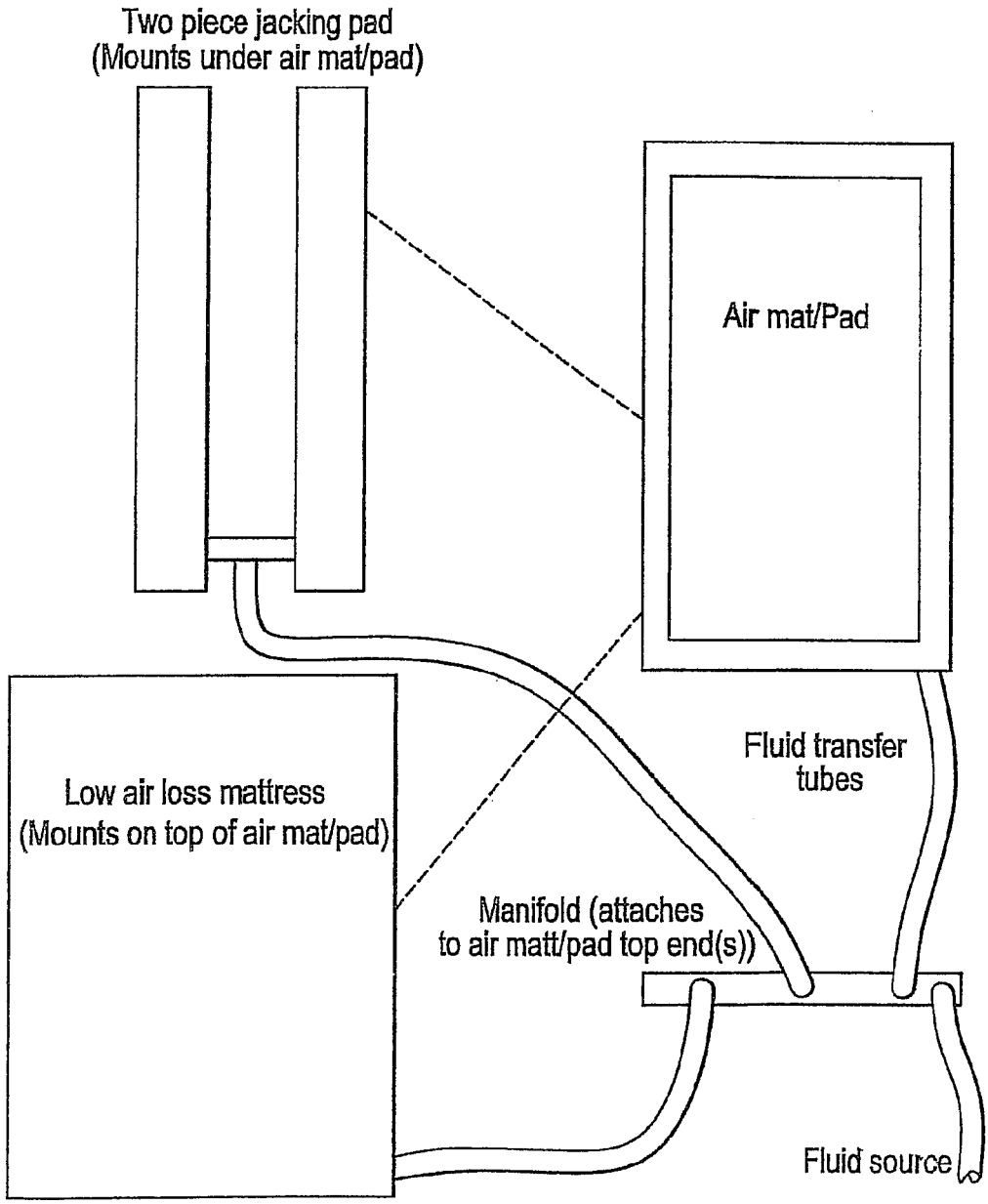
FIG. 8 is a schematic diagram illustrating a mode of assembly for multiple, fluid-filled transfer devices from a single fluid pressurization source.

Moreover, according to another aspect of the present invention, it is also possible to link a number of different devices, each of which operate by providing pressurized fluid thereto, based on a single pressurized fluid source. FIG. 8 is a schematic diagram illustrating a mode of assembly for multiple, fluid-filled transfer devices from a single pressurized fluid source. It should be understood that the present invention is not limited to the examples shown in FIG. 8, and can include any number of different devices as the situation may demand.

What is claimed is:

1. A transfer pad comprising:

a top sheet having an upper surface, a lower surface and a substantially rectangular outer peripheral shape, the top sheet having a width dimension extending in a transverse direction from a first outer peripheral side to an opposed second outer peripheral side thereof, and a length dimension extending in a longitudinal direction from a first outer peripheral end to an opposed second outer peripheral end thereof;

a bottom sheet having an upper surface, a lower surface and a substantially rectangular outer peripheral shape, the bottom sheet having a width dimension extending in the transverse direction from a first outer peripheral side to an opposed second outer peripheral side thereof and a length dimension extending in the longitudinal direction from a first out peripheral end to an opposed second outer peripheral end thereof, wherein the bottom sheet is joined to the top sheet to define a plenum chamber between the lower surface of the top sheet and the upper surface of the bottom sheet, the plenum chamber having a curved but substantially rectangular outer peripheral shape with rounded corners, a plenum chamber width dimension that is smaller than the respective width dimensions of the top and bottom sheets extending in the transverse direction and a plenum chamber length dimension that is smaller than the respective length dimensions of the top and bottom sheets extending in the longitudinal direction, and wherein a portion of the bottom sheet defining the plenum chamber, is perforated in an area corresponding to a footprint of a load receiving portion of the top sheet and surrounding at least a central portion of the bottom sheet defining the plenum chamber in a central fixation area;

a central membrane having an upper surface and a lower surface, a length dimension that is smaller than the plenum chamber length dimension and a width dimension that is smaller than the plenum chamber width dimension, wherein the central membrane is disposed within the plenum chamber and extends across a portion of the width of the plenum chamber and along a portion of the length of the plenum chamber, wherein transversely opposed areas of the upper surface of the central membrane proximate side edges thereof are affixed to portions of the lower surface of the top sheet along the length of the central membrane, and wherein an area of the central membrane, including at least a portion of a longitudinal centerline of the central membrane that divides the width dimension of the central membrane into two equal parts, is affixed to a portion of the upper surface of the bottom sheet in the central fixation area;

a fluid weir, defined by outer peripheral portions of the lower surface of the bottom sheet defining the plenum chamber, and substantially surrounding the perforated portion of the bottom sheet defining the plenum chamber along with a fluid reservoir located between at least a central portion of the lower surface of the bottom sheet defining the plenum chamber and a surface on which the transfer pad is positioned;

a plurality of peripheral flaps extending from the plenum chamber and defined between peripheral sides of the plenum chamber and respective peripheral edges of the top sheet and the bottom sheet;

wherein one or more of the peripheral flaps includes at least one handle portion defined by at least on of an opening formed in the peripheral flap itself and a separate handle device affixed to the peripheral flap either directly or through an opening in the peripheral flap.

2. The transfer pad according to claim 1, wherein a rigid fluid inlet valve is positioned at least at one of the rounded comers of the plenum chamber and extends a distance into the plenum chamber at an acute angle with respect to the longitudinal centerline of the plenum chamber.

3. The transfer pad according to claim 1, wherein a portion of the top sheet is peripherally fixed onto a portion of itself at a first fixation location to define an upper surface portion and distinct sidewall portions of the transfer pad, wherein the terminal peripheral edges of the sidewall portions of the top sheet are joined to the bottom sheet.

4. The transfer pad according to claim 3, wherein a second portion of the top sheet is peripherally fixed onto a portion of itself, in a second fixation location, between the first fixation location and the terminal peripheral edges of the top sheet, to define accordion sidewall portions of the transfer pad.

5. The transfer pad according to claim 1, wherein a width of the top sheet is greater than a width of the bottom sheet.

6. A transfer pad comprising:

a top sheet having an upper surface, a lower surface and a substantially rectangular outer peripheral shape, the top sheet having a width dimension extending in a transverse direction from a first outer peripheral side to an opposed second outer peripheral side thereof, and a length dimension extending in a longitudinal direction from a first outer peripheral end to an opposed second outer peripheral end thereof;

a bottom sheet having an upper surface, a lower surface and a substantially rectangular outer peripheral shape, the bottom sheet having a width dimension extending in the transverse direction from a first outer peripheral side to an opposed second outer peripheral side thereof and a length dimension extending in the longitudinal direction from a first outer peripheral end to an opposed second outer peripheral end thereof, wherein the bottom sheet is joined to the top sheet to define a plenum chamber between the lower surface of the sheet and the upper surface of the bottom sheet, the plenum chamber having a curved but substantially rectangular outer peripheral shape with rounded corners, a plenum chamber width dimension that is smaller than the respective width dimensions of the top and bottom sheets extending in the transverse direction and a plenum chamber length dimension that is smaller than the respective length dimensions of the top and bottom sheets extending in the longitudinal direction, and wherein a portion of the bottom sheet defining the plenum chamber, is perforated in an area corresponding to a footprint of a load receiving portion of the top sheet and surrounding at least a central portion of the bottom sheet defining the plenum chamber in a central fixation area;

a central membrane having an upper surface and a lower surface, a length dimension that is smaller than the plenum chamber length dimension and a width dimension that is smaller than the plenum chamber width dimension, wherein the central membrane is disposed within the plenum chamber and extends across a portion of the width of the plenum chamber and along a portion of the length of the plenum chamber, wherein transversely opposed areas of the upper surface of the central membrane proximate side edges thereof are affixed to portions of the lower surface of the top sheet along the length of the central membrane, and wherein an area of the central membrane, including at least a portion of a longitudinal centerline of the central membrane that divides the width dimension of the central membrane into two equal parts, is affixed to a portion of the upper surface of the bottom sheet in the central fixation area;

a fluid weir, defined by outer peripheral portions of the lower surface of the bottom sheet defining the plenum chamber, and substantially surrounding the perforated portion of the bottom sheet defining the plenum chamber along with a fluid reservoir located between at least a central portion of the lower surface of the bottom sheet defining the plenum chamber and a surface on which the transfer pad is positioned;

a plurality of peripheral flaps extending from the plenum chamber and defined between peripheral sides of the plenum chamber and respective peripheral edges of the top sheet and the bottom sheet;

wherein a width of the top sheet is greater than a width of the bottom sheet; and wherein the peripheral flaps extending from the plenum chamber and defined between peripheral sides of the plenum chamber and peripheral edges of the top sheet include portions of the top sheet fixed to itself and spaced a distance away from the peripheral edges of the top sheet, whereby a sidewall portion of the transfer pad is defined between the terminal edge of the extended fixation portion and the peripheral edges of the top sheet, which are joined to the bottom sheet.

7. A horizontal and vertical transfer pad comprising:

a vertical transfer portion comprising a top sheet having an upper surface, a lower surface and a substantially rectangular outer peripheral shape, the top sheet having a width dimension extending in a transverse direction from a first outer peripheral side to an opposed second outer peripheral side thereof, and a length dimension extending in a longitudinal direction from a first outer peripheral end to an opposed second outer peripheral end thereof;

a bottom sheet having an upper surface, a lower surface and a substantially rectangular outer peripheral shape, the bottom sheet having a width dimension extending in the transverse direction from a first outer peripheral side to an opposed second outer peripheral side thereof and a length dimension extending in the longitudinal direction from a first outer peripheral end to an opposed second outer peripheral end thereof; and one or more interior sheets, each having an upper surface, a lower surface and a substantially rectangular outer peripheral shape, a width dimension extending in the transverse direction from a first outer peripheral side to an opposed second outer peripheral side thereof, and a length dimension extending in the longitudinal direction from a first outer peripheral end to an opposed second outer peripheral end thereof, wherein the outer peripheral sides and the outer peripheral ends of the one or more interior sheets are joined to the outer peripheral sides of at least one of the top sheet, the bottom sheet and an adjacent interior sheet to define an accordion sidewall structure extending between the top and bottom sheets around the outer peripheral shape of the transfer pad and defining a main plenum chamber therein, wherein a plurality of adjacent plenum chamber sections are defined between respective ones of the top sheet, the interior sheets and the bottom sheet, and wherein at least portion of each of the one or more interior sheets includes a damping section defining a predetermined area to provide fluid communication between adjacent vertical plenum chamber sections; and a horizontal transfer section comprising a first sheet defined by the bottom sheet of the vertical transfer section, a second sheet having an upper surface, a lower surface and a substantially rectangular outer peripheral shape, the second sheet having a width dimension extending in the transverse direction from a first outer peripheral side to an opposed second outer peripheral side thereof and a length dimension extending in the longitudinal direction from a end thereof, wherein the second sheet is joined to the first sheet to define a plenum chamber section between the lower surface of the first sheet and the upper surface of the second sheet, the plenum chamber section having a curved but substantially rectangular outer peripheral shape with rounded comers, a plenum chamber section width dimension that is smaller than the width dimension of at least the first sheet extending in the transverse direction and a plenum chamber section length dimension that is smaller than the length dimension of at least the top extending in the longitudinal direction, and wherein a portion of the second sheet defining the plenum chamber, is perforated in an area corresponding to a footprint of a load receiving portion of the top sheet of the vertical transfer section, which surrounds at least a central portion of the second sheet corresponding to a central fixation area, a central membrane having an upper surface and a lower surface, a length dimension that is smaller than the plenum chamber section length dimension and a width dimension that is smaller than the plenum chamber section width dimension, wherein the central membrane is disposed within the plenum chamber section and extends across a portion of the width of the plenum chamber section and along a portion of the length of the plenum chamber section, wherein transversely opposed areas of the upper surface of the central membrane proximate side edges thereof are affixed to portions of the lower surface of the first sheet along the length of the central membrane, and wherein an area including at least a portion of a longitudinal centerline of the central membrane, which divides the width, dimension of the central membrane into two equal parts, is affixed to a portion of the upper surface of the second sheet in a location corresponding to the central fixation area, and a fluid weir, defined by outer peripheral portions of the lower surface of the second sheet and substantially surrounding the perforated portion of the second sheet along with a fluid reservoir located between at least a central portion of the lower surface of the second and a surface on which the vertical and horizontal transfer pad is positioned.

* * * * *